United States Patent [19]

Kirk

[11] Patent Number: 4,503,365

[45] Date of Patent: Mar. 5, 1985

[54] POWER SUPPLY SYSTEM FOR LOW COLD RESISTANCE LOADS

[75] Inventor: Thomas E. Kirk, Anderson, Ind.

[73] Assignee: General Motors Corporation, Detroit, Mich.

[21] Appl. No.: 433,396

[22] Filed: Oct. 8, 1982

[51] Int. Cl.[3] ..... H05B 39/02

[52] U.S. Cl. ..... 315/310; 361/21; 361/58; 323/908; 315/127

[58] Field of Search ..... 315/82, 78, 74, 121, 315/127, 302, 310, 311; 323/233, 908; 322/7; 361/21, 58, 20; 307/99

[56] References Cited

U.S. PATENT DOCUMENTS

| | | | |
|---|---|---|---|
| 3,332,004 | 7/1967 | Shano | 322/28 |
| 3,597,654 | 8/1971 | Harland, Jr. et al. | 361/21 X |
| 3,935,511 | 1/1976 | Boulanger et al. | 361/58 |
| 3,938,005 | 2/1976 | Cummins | 361/21 |
| 4,396,882 | 8/1983 | Kellenbenz | 361/58 X |

*Primary Examiner*—David K. Moore
*Assistant Examiner*—Vincent DeLuca
*Attorney, Agent, or Firm*—C. R. Meland

[57] ABSTRACT

A power supply system for feeding low cold resistance incandescent lamps from a diode-rectified alternating current generator where the system does not have a battery or other voltage source for energizing the lamps. A control circuit is connected between the generator and lamps that includes a resistor that can be bypassed by the closure of relay contacts. The control circuit energizes the lamps such that generator voltage does not collapse when the relay contacts close. The resistor can have a negative temperature coefficient of resistance.

7 Claims, 2 Drawing Figures

ENGINE

POWER SUPPLY SYSTEM FOR LOW COLD RESISTANCE LOADS

This invention relates to an electrical system for supplying an electrical load from an alternating current generator, where the load has a very low, cold resistance and more particularly to an electrical system for supplying an incandescent lamp load from a diode-rectified alternating current generator which is the sole power supply for the lamp load.

Power supply systems for incandescent lamps that are fed by a diode-rectified alternating current generator are well known and are used on motor vehicle systems where the lamps are also fed by a storage battery that is charged by the generator. The lamps have a very low cold resistance which increases after being energized. The low cold resistance of the lamps, which approaches that of a short circuit, can place a heavy load on the system when energized. With a system that has a battery, the battery supplies current to the lamps which causes the resistance of the lamps to increase so that the generator is not overloaded to an extent that it cannot maintain the load.

There is a need for generator fed power supply systems for incandescent lamps, however, that do not include a battery. As an example, portable lighting equipment may be required for remote areas that have no source of electric power and to reduce complexity and weight of the equipment no battery is utilized. The lighting can be accomplished by supplying lamps from a diode-rectified alternating current generator that is driven by a small engine that is hand pulled to start the engine. In such a system there is no battery to initially energize the lamps to cause lamp resistance to increase and because of this the alternating current generator is confronted with virtually a short-circuit load when the lamps are connected to the generator. Without the control system of this invention the connection of a cold lamp load to the generator would load the generator to such an extent that its terminal voltage would drop substantially to zero with the result that the lamps would not be energized sufficiently to raise lamp resistance to a value that can be handled by the generator.

A prior art patent that is concerned with supplying an electrical load from a diode-rectified alternating current generator, where the system does not include a battery is the U.S. Pat. No. 332,004 to Shano. In this patent a transistor switch is connected between the rectifier and load and the switch remains non-conductive until generator voltage reaches some value. This arrangement allows the generator voltage to build up before the load is connected to the generator.

In systems of the type disclosed in the above referenced Shano patent, the load is not connected to the generator until generator voltage attains some value. However, even where generator voltage has increased to a value near its desired output voltage the connection of a high current load, such as incandescent lamp load to the generator, may cause generator output voltage to collapse to near zero with the result that the lamps are not energized sufficiently to raise the lamp resistance to a value that can be handled by the generator.

It accordingly is one of the objects of this invention to provide a power supply system that feeds incandescent lamps from an alternating current generator where the system does not include a battery or other voltage source for energizing the lamps and wherein control circuitry is provided for energizing the lamps in such a manner that generator voltage does not collapse when the lamps are connected to the generator.

In carrying the foregoing object forward, a lamp energizing control is provided which causes the lamps to be energized from the generator through a resistor when a lamp control switch is closed. The resistor limits the in-rush current to a value that will not cause generator voltage to collapse while at the same time energizing the lamps to cause lamp resistance to increase. After the lapse of a time period, a power switch is closed to bypass the resistor and energize the lamps directly from the generator. In one form of the lamp control a timing circuit is provided to provide the time period between closure of the lamp control switch and the power switch. The timing circuit is arranged to cause a cycling on-off operation of the power switch to thereby alternately energize the lamps through the resistor and power switch. This causes the resistance of the lamps to increase without causing a collapse in generator voltage and eventually lamp resistance increases to a point where the power switch can be continuously closed to energize the lamps.

In another form of the invention the resistor that limits in-rush current has a negative temperature coefficient of resistance so that when the lamps are energized through the resistor the resistance of the resistor decreases while simultaneously the resistance of the lamps increases. When the voltage across the lamps rises to some value a power switch is closed to bypass the resistor.

Another object of this invention is to provide a power supply system for incandescent lamps of the type that has been described wherein the power source is a diode-rectified alternating current generator which has its output voltage regulated to a desired value by a voltage regulator which senses generator output voltage and varies field current to maintain output voltage substantially constant.

Still another object of this invention is to provide a power control circuit for incandescent lamps of the type that has been described wherein the timing circuit for controlling the closure of the power switch is reset by a voltage transient which is developed when the lamp control switch is opened.

IN THE DRAWINGS

Figures 1, 2:
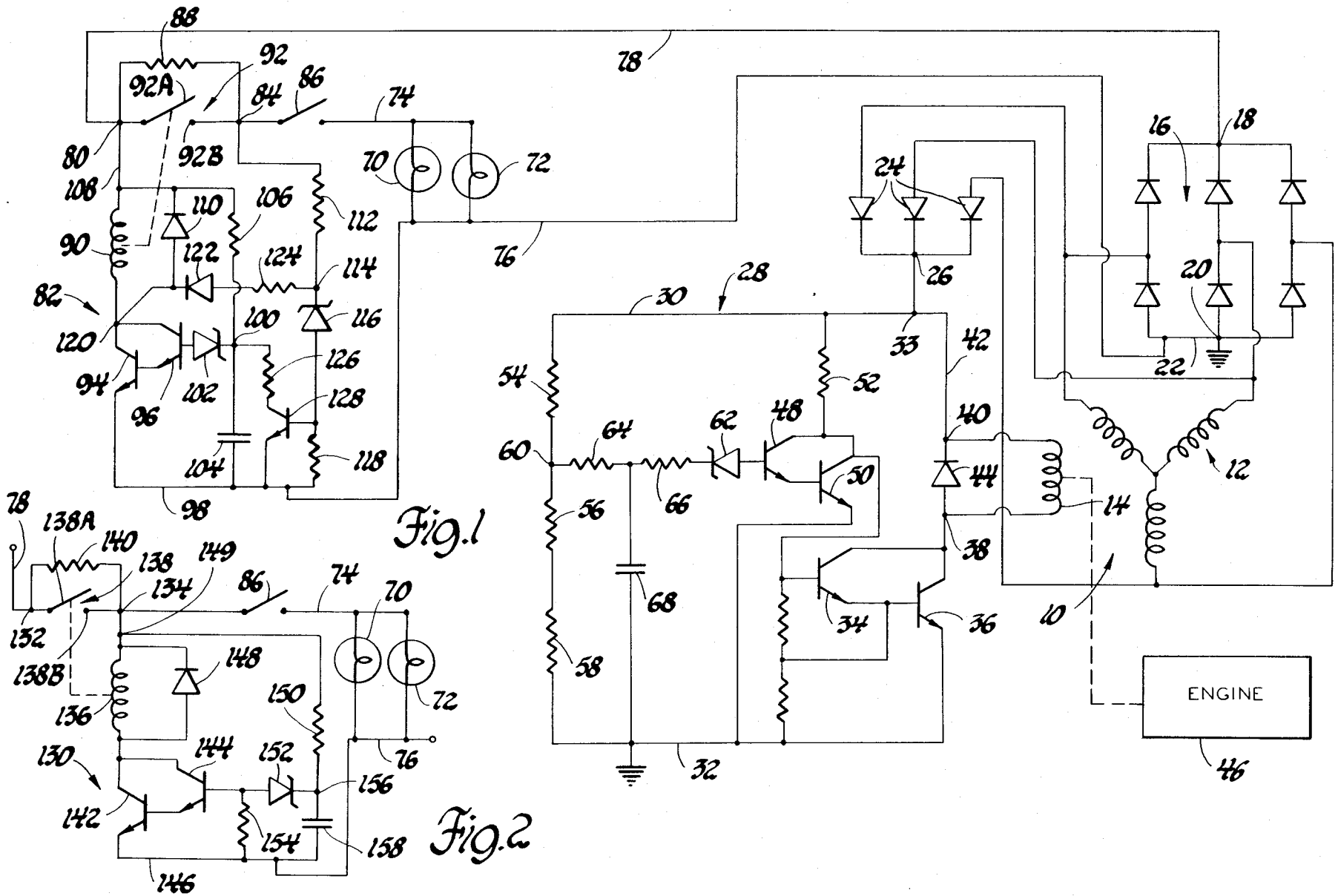
FIG. 1 is a schematic circuit diagram of a power supply system made in accordance with this invention.
FIG. 2 illustrates a modified power control circuit which can be utilized in the system shown in FIG. 1.

Referring now to the drawings and more particularly to FIG. 1 the reference numeral 10 generally designates an alternating current generator which has a three-phase Y connected output winding 12 and a field winding 14. The three-phase output winding is connected to the AC input terminals of a three-phase full-wave bridge rectifier generally designated by reference numeral 16. The bridge rectifier 16 has a positive direct voltage output terminal 18 and a negative direct voltage output terminal 20 connected to conductor 22 which is grounded. The three-phase output winding 12 is connected to a so-called diode-trio comprised of three diodes 24. The cathodes of diodes 24 are connected to a junction 26 and the direct voltage appearing between junction 26 and ground is utilized to energize the field winding 14 of the generator in a manner to be more fully described hereinafter.

The output voltage of the diode-rectified alternator appearing between junction 18 and ground is regulated by a conventional transistor voltage regulator generally designated by reference numeral 28. The transistor voltage regulator includes conductors 30 and 32, the conductor 30 being connected to a junction 33 fed from junction 26 and the conductor 32 being grounded. The regulator includes Darlington connected NPN transistors 34 and 36. The emitter of transistor 36 is grounded as illustrated while the collector of transistor 36 is connected to a junction 38 that is in turn connected to one side of field winding 14. The opposite side of field winding 14 is connected to a junction 40 that is in turn connected to a conductor 42. The junctions 38 and 40 represent the slip rings and brushes of the alternating current generator which feed the field winding 14 that is carried by the rotor of the generator in a well known manner. A field discharge diode 44 is connected across the field winding 14.

The rotor of the alternating current generator carries the field winding 14 and is driven by an engine designated by reference numeral 46. The engine 46 is of the small portable type which does not have an electric starter and which can be started by manually cranking the engine to start it.

The magnetic parts of the alternating current generator 10 have sufficient magnetic retentivity to provide sufficient residual magnetism to cause generator voltage to build up without exciting the field winding 14 from a power source when the engine drives the rotor of the generator.

The Darlington connected transistors 34 and 36 switch on and off to control field current. These transistors are connected with Darlington connected NPN driver transistors 48 and 50. The emitter of transistor 50 is grounded and its collector is connected to the base of transistor 34. The collectors of transistors 48 and 50 are connected to conductor 30 by a resistor 52. The transistor regulator has a voltage divider comprised of series connected resistors 54, 56 and 58 connected between conductors 30 and 32. This voltage divider has a junction 60 that is connected to a Zener diode 62 via resistors 64 and 66. A capacitor 68 is connected between the junction of resistors 64 and 66 and the grounded conductor 32.

The transistor voltage regulator maintains the voltage between junction 18 and ground at a substantially constant regulated value for example 14 volts in a twelve volt system. The voltage divider of the transistor voltage regulator senses the voltage between junction 26 and ground which is very nearly the same voltage as between junction 18 and ground. The junction 60 therefore has a voltage that is a function of the output voltage of the generating system. When this voltage exceeds a desired regulated value the Zener diode 62 conducts in a reverse direction biasing transistors 48 and 50 conductive. With transistors 48 and 50 biased conductive the base voltage of transistor 34 is reduced to a value that causes transistors 34 and 36 to be biased nonconductive. As generator output voltage now decreases the Zener diode eventually resumes a blocking state biasing transistors 48 and 50 nonconductive and transistors 34 and 36 conductive. This switching action of transistors 34 and 36 switches field current on and off to maintain a desired regulated output voltage as is well known to those skilled in the art.

The electrical system shown in FIG. 1 does not include a battery or any other power source for energizing the electrical load to be described or for initially exciting the field winding 14 so as to cause the generator voltage to build up when the rotor of the generator is driven. The magnetic parts of the generator including the rotor, however, have sufficient residual magnetism so as to cause a small voltage to be generated in the output winding 12 when the rotor carrying the field winding 14 is driven by the engine 46. The small voltage generated when the rotor of the generator is initially driven is sufficient to develop a small voltage at the output terminal 26 of the diode trio 24. This voltage is below the desired regulated value and therefore causes the transistors 34 and 36 to be switched fully conductive. A small field current is now supplied to the field winding 14 via a circuit that can be traced from junction 26, through conductor 42, through field winding 14 and then through conducting transistors 34 and 36. As the field winding now receives a small field current the generator begins to build up in voltage and eventually builds up to the desired regulated value of for example 14 volts whereupon the transistor voltage regulator causes the transistors 34 and 36 to switch on and off to maintain the desired regulated voltage.

The generator voltage regulator system of this invention can take the form of a diode-rectified alternating current generator of the type that is utilized for battery charging systems on motor vehicles.

The diode-rectified alternator supplies an incandescent lamp load comprised of incandescent lamps 70 and 72 which are connected across power supply conductors 74 and 76. Only two incandescent lamps are illustrated in FIG. 1 but in a preferred arrangement four lamps are connected across power supply conductors 74 and 76. The lamps may be sealed beam headlamps having a 12 volt, 8 amp rating and an individual cold unenergized resistance of approximately 0.25 ohms. When the lamps have been energized to raise their resistance to a rated value the resistance may increase by 5 to 7 times and in a heated normal operating condition may have an individual resistance of 1.75 ohms. The initial cold parallel resistance of four lamps may be in the order of 0.06 ohms which is virtually a short circuit for the generator. This resistance may increase to approximately 0.4 ohms when the lamps are heated by energizing current up to their normal resistance value. It thus is seen that the lamps have a very low cold resistance which approaches that of a short circuit.

The power supply conductor 76 which is connected to one side of the lamps 70 and 72 is connected to the grounded conductor 22 of the bridge rectifier 16. The positive direct voltage output terminal 18 of the bridge rectifier 16 is connected to a power supply conductor 78. The power supply conductor 78 is connected to an input terminal 80 of a lamp control circuit generally designated by reference numeral 82. The lamp control circuit 82 has an output terminal 84 connected in series with a manually operable lamp control switch designated by reference numeral 86 connected in series between junction 84 and conductor 74. The lamp control switch can be manually closed when the generator is operating to energize the lamps 70 and 72. Connected between junctions 80 and 84 is a resistor 88 having a fixed resistance which is higher than the cold resistance of the lamps and approximately 0.5 ohms.

The control circuit 82 includes a relay having an actuating coil 90 controlling relay contacts 92 comprised of a movable contact 92A and a fixed contact 92B. The relay contacts 92 are held normally open by a spring which is not illustrated and are closed whenever actuating coil 90 is energized. The relay contacts 92 are connected in parallel with resistor 88 so that when the relay contacts are closed the resistor 88 is short circuited and the lamps can be energized via the closed relay contacts and closed control switch 86.

The relay actuating coil 90 is connected between junction 80 and Darlington connected NPN transistors 94 and 96. The emitters of these transistors are connected to a conductor 98 which in turn is connected to power supply conductor 76. When transistors 94 and 96 are biased conductive the relay actuating coil 90 is energized to close relay contacts 92.

The conduction of transistors 94 and 96 depends on the voltage level at junction 100. A Zener diode 102 is connected between junction 100 and the base of transistor 96. The Zener diode may have a breakdown voltage of for example 5 volts. A capacitor 104 connects junction 100 to conductor 98 and a resistor 106 is connected between junction 100 and conductor 108. The actuating coil 90 of the relay has a diode 110 connected across it.

A circuit is connected between junction 84 and conductor 98 which is comprised of resistor 112, junction 114, Zener diode 116 and resistor 118. The junction 114 is connected to junction 120 by diode 122 and a resistor 124. The capacitor 104 is shunted by a circuit comprised of resistor 126 and the collector-emitter circuit of an NPN transistor 128.

The operation of the electrical system shown in FIG. 1 will now be described. Assuming that it is desired to energize the incandescent lamps 70 and 72 the engine 46 is started which causes the rotor of the generator 10 to be driven by the engine. The generator voltage now builds up due to residual magnetism in a manner described above. Before the lamp control switch 86 is closed the generator is operating essentially open circuit with the direct voltage developed at conductor 78 connected to supply resistor 88 and the high impedance circuit comprised of resistor 112, Zener diode 116 and resistor 118. The reverse breakdown voltage of Zener diode 116 may be for example 7 volts. Since the generator is essentially operating open circuit the voltage at junction 84 is substantially equal to the voltage on conductor 78 which for purposes of explanation will be considered to be 14 volts. The voltage at junction 84 is sufficient to cause Zener diode 116 to conduct in a reverse direction thereby providing current through resistor 118 to bias transistor 128 conductive. With transistor 128 conducting, a current path is established between junction 80 and conductor 98 that includes conductor 108, resistor 106, junction 100, resistor 126 and conducting transistor 128. The voltage at junction 100 is now maintained low so that Zener diode 102 blocks base drive for transistors 94 and 96 and therefore these transistors are non-conductive and relay coil 90 is not energized. Further, the conduction of transistor 128 prevents capacitor 104 from being charged since it is bypassed by the conducting transistor.

With the system operating in the mode that has just been described the switch 86 can now be closed to energize lamps 70 and 72. When switch 86 is closed the lamps are energized through the 0.5 ohm resistor 88. The cold resistance of the lamps 70 and 72 is very low as previously explained and as a result the voltage at junction 84 drops to a low value when switch 86 is closed. The voltage at junction 84 goes so low that Zener diode 116 resumes a blocking state thereby biasing transistor 128 nonconductive. When transistor 128 goes nonconductive the capacitor 104 can charge through resistor 106 from junction 80. The voltage on capacitor 104 increases at a time rate which is a function of the RC time constant of resistor 106 and capacitor 104 and when the voltage across the capacitor attains a predetermined value the Zener diode 102 conducts in a reverse direction biasing transistors 96 and 94 conductive. This causes relay coil 90 to be energized and contacts 92 of the relay are now closed. The closure of relay contacts 92 energizes the lamps 70 and 72 through a circuit that now bypasses the resistor 88. The conduction of transistors 94 and 96 lowers the voltage at junction 120 which in turn lowers the voltage at junction 114. The voltage at junction 114 is held at a value which is not sufficient to break down the Zener diode 116 with the result that transistor 128 remains biased nonconductive. Further, since transistor 128 is nonconductive, base drive can be supplied to transistors 96 and 94 from junction 80 via a circuit that includes conductor 108, resistor 106 and the Zener diode 102 which is now conducting in its reverse direction. It thus is seen that when transistors 96 and 94 were initially biased conductive a holding circuit including resistor 124 and diode 122 holds the system in such a condition that transistors 96 and 94 remain conductive. Thus, Zener diode 116 and transistor 128 are held non-conductive by the low voltage at junction 120 which causes a low voltage to exist at junction 114.

When switch 86 is initially closed the lamps 70 and 72 begin to heat up at a slow rate since they are energized through resistor 88. When relay contacts 92 close full generator voltage is applied to the lamps 70 and 72. When relay contacts 92 first close the generator will be loaded to such an extent that its voltage will decrease causing the voltage of junction 80 to decrease. This voltage drops to a value such that the voltage at junction 100 will be lowered to such an extent that Zener diode 102 will resume its blocking state therefore biasing transistors 94 and 96 nonconductive and deenergizing relay coil 90 to open contacts 92. The lamps will now be energized again via resistor 88 and closed switch 86 and the voltage at junction 84 will start to rise. At this time capacitor 104 recharges and when the voltage at junction 100 reaches a value sufficient to cause Zener diode 102 to conduct transistors 96 and 94 are again biased conductive to energize relay coil 90 and close contacts 92. The control 82 of FIG. 1 continues to cycle the system through repetitive on and off operation of relay contacts 92 in a manner described above until a voltage is developed at junction 100 which is maintained above the breakdown voltage of Zener diode 102 whereupon transistors 94 and 96 are biased continuously conductive to maintain relay contacts 92 continuously closed.

In summary, the control 82 of FIG. 1 cycles relay contacts 92 open and closed to alternately energize the lamps 70 and 72 through the resistor 88 or through the closed relay contacts 92. As the lamps are being energized, their resistance increases and when closure of switch contacts 92 does not result in the lowering of the voltage at junction 100 below the breakdown voltage of Zener diode 102 the relay contacts 92 are maintained closed to energize the lamps 70 and 72. The lamps thus come up to their rated current and resistance level and are continuously energized. The time constant of resistor 106 and capacitor 104 may be such that relay contacts 92 close at about two seconds after switch 86 is closed.

When control switch 86 is opened to deenergize lamps 70 and 72 a transient voltage is developed at junction 84. This voltage is applied to resistor 112, Zener diode 116 and resistor 118 and is high enough to cause conduction of Zener diode 116 and transistor 128. This lowers the voltage at junction 100 to a point where Zener diode 102 no longer conducts biasing transistors 96 and 94 nonconductive and therefore deenergizing relay coil 90 to open the contacts 92. This resets the system for another closure of control switch 86.

FIG. 2 illustrates a modified lamp control circuit which can be substituted for the control circuit 82 of FIG. 1. In FIG. 2 the same reference numerals have been used as were used in FIG. 1 to illustrate corresponding parts. The control circuit of FIG. 2 has been generally designated by reference numeral 130 and has an input terminal 132 connected to conductor 78 and an output terminal 134 connected to lamp control switch 86. The control of FIG. 2 includes a relay having a relay actuating coil 136 and normally open relay contacts 138 comprised of a movable contact 138A and a fixed contact 138B. A resistor 140 is connected between terminals 132 and 134 and in parallel with the relay contacts 138. The resistor 140 instead of being a resistor having a fixed resistance value is a resistor which has a negative temperature coefficient of resistance. As one example this resistor may be a so-called current in-rush limiter (Keystone-Carbon type CL-100). The cold resistance of resistor 140 is approximately 0.5 ohms and decreases to approximately 0.1 ohm as the resistor is heated by $I^2R$ heating.

The relay coil 136 is connected in series with Darlington connected transistors 142 and 144. When transistors 142 and 144 are conductive the relay actuating coil 136 is energized from a circuit that can be traced from junction 134 to conductor 146. A diode 148 is connected across the relay coil 136. The conduction of transistors 142 and 144 is controlled by a circuit connected between junction 149 and conductor 146 that includes resistor 150, Zener diode 152 and resistor 154. The Zener diode 152 is connected between the base of transistor 144 and junction 156. A filter capacitor 158 connects junction 156 to conductor 146. The reverse breakdown voltage of Zener diode 152 may be approximately 7 volts in a 12 volt system.

The operation of the modified control circuit shown in FIG. 2 will now be described. Assuming that the engine 46 has been started to drive the generator and that the generator has developed its rated output voltage, the switch 86 can be closed to energize lamps 70 and 72.

With switch 86 closed, the lamps are now energized through resistor 140. The voltage at junction 134 is a function of the voltage drop across lamps 70 and 72 and accordingly is very low and is not sufficient to cause the Zener diode 152 to break down in a reverse direction. The resistance of lamps 70 and 72 is now increasing since they are being energized while the resistance of resistor 140 is simultaneously decreasing due to heating of resistor 140. Therefore, the voltage at junction 134 increases due to both a decreasing resistance at resistor 140 and an increasing resistance of lamps 70 and 72. When the voltage at junction 134 rises above approximately 7 volts the Zener diode 152 breaks down in a reverse direction causing transistors 144 and 142 to be biased conductive. This energizes the relay coil 136 from junction 134 with the result that relay contacts 138 now close to bypass the resistor 140. The lamps 70 and 72 are now energized directly through the closed relay contacts 138 and their resistance increases to its normal energized value. In the system of FIG. 2, the relay contacts 138 are not closed until the voltage at junction 134 rises to such a value that closure of relay contacts 138 will not cause generator output voltage to collapse or putting it another way relay contacts 138 are not closed until the resistance of lamps 70 and 72 has inqreased to such a value that the generator can maintain the load at the instant the contacts 138 close. In the circuit of FIG. 2 the resistor 140 and the lamps 70 and 72 in effect operate as a timing circuit which does not allow the closure of relay contacts 138 until the voltage at junction 134 has increased to some value. The circuit of FIG. 2 will bring the lamps 70 and 72 up to full brilliance at a faster rate than the circuit of FIG. 1 and also has a reduced number of components, and therefore reduced cost.

As previously mentioned, the engine 46 can be a small portable engine that is connected to drive a diode-rectified alternator of the type that is utilized on motor vehicles. The engine is manually cranked since no electric starter is provided and the sealed beam headlights can be used to light, for example, campsite areas in remote locations.

The embodiments of the invention in which an exclusive property or privilege is claimed are defined as follows:

1. An electrical system for energizing an incandescent lamp load from a self-excited alternating current generator comprising, an alternating current generator having an output winding and a field winding, means for exciting said field winding from said output winding comprising voltage regulator means providing a conductive path between said output winding and field winding, load conductors, at least one incandescent lamp connected across said load conductors having a low cold resistance and a resistance that increases when energized, a lamp control switch, a resistor having a higher resistance than the cold resistance of said lamp, means connecting said control switch and resistor in series between said generator output winding and a load conductor whereby said lamp is energized through said resistor when said control switch is closed, switching means connected in parallel with said resistor to bypass the resistor when closed, means responsive to closure of said control switch for energizing a timing circuit that is operative to cause said switching means to close after the elapse of a timing period determined by said timing circuit, and means responsive to the voltage across the lamp for cycling said switching means on and off until lamp voltage is maintained above a minimum value and for thereafter maintaining said switching means closed to continuously energize the lamp through the closed switching means.

2. An electrical system for supplying an incandescent lamp load from a self-excited diode-rectified alternating current generator comprising, an alternating current generator having an output winding and a field winding, rectifier means connected to said output winding having direct voltage output terminals, means for exciting said field winding from said output winding comprising voltage regulator means responsive to generator output voltage, lamp supply conductors, at least one incandescent lamp connected across said supply conductors having a low cold resistance and a resistance that increases when energized, a lamp control switch, a resistor having a resistance that is higher than the cold resistance of said lamp, means connecting one of said lamp supply conductors to an output terminal of said rectifier means, means connecting said control switch and resistor in series between the other output terminal of the rectifier means and the other lamp supply conductor whereby said lamp is energized through said resistor when said control switch is closed, an RC timing circuit, means responsive to closure of said control switch for energizing said timing circuit from the output terminals of said rectifier means, a switching means connected in parallel with said resistor to bypass the resistor when closed, means coupled to said timing circuit for causing said switching means to close after the elapse of a time period determined by the operation of the timing circuit, means for causing said switching means to cycle on and off until load voltage is maintained above a predetermined value, a holding circuit for maintaining said switching means closed once load voltage is maintained above said value, and means responsive to the voltage transient produced when said control switch is opened for causing said switching means to open and for resetting the system to provide control by said timing circuit.

3. An electrical system for energizing an electrical load from an alternating current generator comprising, an alternating current generator having an output winding and a field winding, circuit means including voltage regulator means for exciting said field winding from said output winding, an electrical load having a low cold resistance which increases when energized, a load control switch, a resistor having a negative temperature coefficient of resistance and a cold resistance that is higher than the cold resistance of said electrical load, means connecting said control switch and resistor in series between said generator output winding and said load whereby said load is energized through said resistor when said control switch is closed to thereby cause the resistance of said resistor to decrease and the resistance of said load to increase, a switching means connected in parallel with said resistor, and means responsive to a load voltage magnitude which is above a predetermined value for causing said switching means to close, said magnitude corresponding to a load voltage that is high enough that when said switching means closes the generator can maintain its output voltage.

4. An electrical system comprising, an alternating current generator having an output winding and a field winding, circuit means for exciting said field winding from output winding, an electrical load having a low cold resistance which increases when energized, a load control switch, a resistor having a resistance that is higher than the cold resistance of said load, means connecting said control switch and resistor in series between said output winding and load whereby said load is energized through said resistor to thereby increase its resistance when said control switch is closed, switching means connected in parallel with said resistor, and cycling means including a timing means for cycling said switching means on and off in response to load voltage variations until load voltage is maintained above a minimum value and for thereafter maintaining said switching means closed to continuously energize the load through the closed switching means, said cycling means being set into operation by initial closure of said control switch and providing a time delay between initial closure of said control switch and closure of said switching means to permit an initial increase in resistance of said load for the period of said time delay.

5. A lamp energizing control circuit connectable between a rectifier means fed by an alternating current generator and an incandescent lamp load comprising, an input terminal adapted to be connected to an output terminal of said rectifier means and an output terminal adapted to be connected to circuit means feeding said lamp load, a common terminal adapted to be connected to the other output terminal of said rectifier means and to one side of said lamp load, a resistor having a resistance which is higher than the cold resistance of said lamp load connected between said input and output terminals, a first switching means connected in parallel with said resistor, an RC timing circuit connected between said input and common terminals, means operative to actuate said switching means closed when the capacitor of said RC timing circuit attains a predetermined voltage, second switching means shunting said capacitor, and means responsive to the magnitude of the voltage at said output terminal for actuating said second switching means closed when the voltage at said output terminal exceeds a predetermined value.

6. A lamp energizing control circuit connectable between a rectifier means fed by an alternating current generator and an incandescent lamp load comprising, an input terminal adapted to be connected to an output terminal of said rectifier means and an output terminal adapted to be connected to circuit means feeding said lamp load, a common terminal adapted to;be connected to the other output terminal of said rectifier means and to one side of said lamp load, a resistor having a negative temperature coefficient of resistance connected between said input and output terminals, a switching means connected in parallel with said resistor, and voltage responsive means sensing the voltage at said output terminal operative to actuate said switching means closed when the magnitude of the voltage at said output terminal exceeds a predetermined value.

7. An electrical system for supplying an incandescent lamp load from a self-excited diode-rectified alternating current generator comprising, an alternating current generator having an output winding and a field winding and sufficient residual magnetism as to cause a small voltage to be generated in said output winding without external excitation of the field winding when the rotor of the generator is driven, rectifier means connected to said output winding having direct voltage output terminals, means for exciting said field winding from said output winding comprising voltage regulator means responsive to generator output voltage, lamp supply conductors, at least one incandescent lamp connected across said supply conductors having a low cold resistance and a resistance that increases when energized, a lamp control switch, a resistor having a resistance that is higher than the cold resistance of said lamp, means connecting one of said lamp supply conductors to an output terminal of said rectifier means, means connecting said control switch and resistor in series between the other output terminal of the rectifier means and the other lamp supply conductor whereby said lamp is energized through said resistor when said control switch is closed, an RC timing circuit, means responsive to closure of said control switch for energizing said timing circuit from the output terminals of said rectifier means, a switching means connected in parallel with said resistor to bypass the resistor when closed, means coupled to said timing circuit for causing said switching means to close after the elapse of a time period determined by the operation of said timing circuit, and means for disabling said timing circuit when said generator initially develops an output voltage and said lamp control switch is in an open condition.

* * * * *